US005080349A

United States Patent [19]

Vittone

[11] Patent Number: 5,080,349

[45] Date of Patent: Jan. 14, 1992

[54] EXERCISE APPARATUS FOR PERFORMING TWO-HANDED EXERCISES

[76] Inventor: Larry W. Vittone, Rt. 2, Box 23, Oliver Springs, Tenn. 37840

[21] Appl. No.: 595,268

[22] Filed: Oct. 9, 1990

[51] Int. Cl.[5] ..... A63B 21/072

[52] U.S. Cl. ..... 272/123; 272/117; 272/143

[58] Field of Search ..... 272/67, 117, 118, 119, 272/122, 123, 143

[56] References Cited

U.S. PATENT DOCUMENTS

| | | | |
|---|---|---|---|
| 2,508,567 | 5/1950 | Dymeck . | |
| 3,384,370 | 5/1968 | Bailey et al. . | |
| 4,461,473 | 7/1984 | Cole | 272/123 |
| 4,585,229 | 5/1986 | Brasher | 272/123 |
| 4,618,143 | 10/1986 | Twardosz | 272/123 |
| 4,629,184 | 12/1986 | Selkee | 272/123 |
| 4,743,018 | 5/1988 | Eckler | 272/123 |
| 4,822,035 | 4/1989 | Jennings et al. | 272/123 |
| 4,836,535 | 6/1989 | Pearson | 272/123 X |

FOREIGN PATENT DOCUMENTS

| | | | |
|---|---|---|---|
| 223926 | 6/1985 | German Democratic Rep. | 272/122 |

*Primary Examiner*—Robert Bahr

*Attorney, Agent, or Firm*—Luedeka, Hodges, Neely & Graham

[57] ABSTRACT

An exercise apparatus for performing two-handed exercises includes a frame to which weights are connected and a pair of hand grip assemblies with which the frame is moved by the user between two positions of movement during an exercise routine. Each hand grip assembly includes a ring and an elongated grip joined to so as to extend generally across the center of the ring. Each ring is pivotally connected to the frame in a manner which permits the ring to pivot relative to the frame about a pivot axis which is fixed in position relative to the frame and disposed across the ring and arranged generally perpendicular to the grip. When the frame is moved between two positions of movement with the hands grasped about the elongate grips, the rings are permitted to pivot relative to the frame to accommodate an adjustment in position of the wrists of the grasping hands.

20 Claims, 3 Drawing Sheets

EXERCISE APPARATUS FOR PERFORMING TWO-HANDED EXERCISES

This invention relates generally to exercise equipment and relates more particularly to exercise equipment intended to be grasped by the hands of a user and moved between two positions during an exercise routine.

Known exercise apparatus of the curling or hand pull-type includes an elongated weightlifting bar to which weights are directly attached, usually outside the hand or hands of the user, and a pull-down bar to which weights are connected by way of a pulley and cable or lever arrangement so that the weights oppose a pull upon the bar. Such a weightlifting bar may be used during arm-strengthening exercises, such as curling exercises, wherein the bar is lifted and lowered by movement of the forearms and hands which pivot about the elbow joints between arm-folded and arm-extended positions. Pull-down bars may be used during arm and/or torso-strengthening exercises wherein the bar is pulled downwardly from a raised position to a lowered position and subsequently permitted to return to the raised position. In those exercises, the forearms and hands also generally pivot about the elbow joint between arm-folded and arm-extended positions.

A limitation associated with known exercise equipment such as the aforedescribed weightlifting and pull-down bars relates to the inability of the equipment to accommodate an adjustment in position of the user's hands, such as a rotation of the hands at the wrist, during an exercise routine without exposing the user's wrists to undue strain.

Accordingly, it is an object of the present invention to provide an exercise apparatus for performing two-handed exercises.

Another object of the invention is to provide an exercise apparatus for the performance of two-handed exercises which accommodates a degree of adjustment in position of the user's hands during an exercise routine.

A further object of the present invention is to provide an exercise apparatus of the character described which accommodates an adjustment in position of the user's hands by enabling rotation of the user's hands and forearms as they are pivoted about the elbow joint during the performance of an exercise using the apparatus.

Still another object of the invention is to provide an exercise apparatus of the character described which enables rotation of the hands and forearms in a new and improved manner which avoids the imposing of undue or undesirable body stresses during an exercise routine.

Yet another object of the invention is to provide an exercise apparatus of the character described which is uncomplicated in construction and effective in operation.

The present invention relates to an exercise apparatus which comprises a frame connected to resistance means for providing a force in opposition to attempted movement of the frame between first and second positions and a grip for enabling a user to grip and hold the frame along a grip axis for moving the frame between the first and second positions in opposition to the resistance means. The grip is supported across a ring member which is pivotally connected to the frame for pivotal movement of the ring member relative to the frame about a fixed pivot axis that is disposed across the ring member and generally perpendicular to the grip axis.

The pivotal movement of the ring member enables adjustment of user's wrists in an advantageous manner during the performance of an exercise during which the frame is moved between the first and second positions in opposition to the resistance means.

Figure 1:
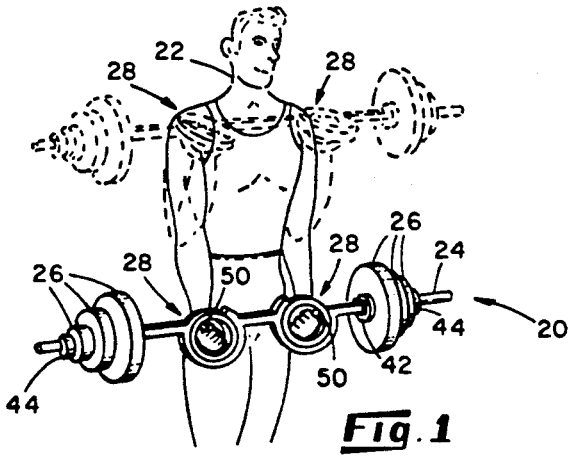
FIG. 1 is a perspective view of one embodiment of an exercise apparatus shown being used during an exercise routine.

Turning now to the drawings in greater detail, there is illustrated in FIG. 1 an embodiment 20 of an exercise apparatus shown being used by a user 22 while performing a curling exercise routine. The embodiment 20 includes an elongated frame 24 to which resistance means in the form of weights 26 are attached and a pair of hand grip assemblies 28 pivotally mounted along the length of the frame 24. During the course of an exercise routine being performed with the depicted apparatus 20, the hand grip assemblies 28 are grasped by the user's hands and the frame 24 is moved by the hands between a lowered position, illustrated in solid lines in FIG. 1, and a raised position, illustrated in phantom lines in FIG. 1. As the frame 24 is moved between its raised and lowered positions, each hand grip assembly 28 is permitted to pivot relative to the frame 24 to accommodate an adjustment in position in the wrist of the grasping hand relative to the frame 24. As the hand grip assemblies 28 are permitted to pivot in a manner described herein, the likelihood that the wrists of the grasping hands will be exposed to undue strain is substantially reduced.

Figure 2:
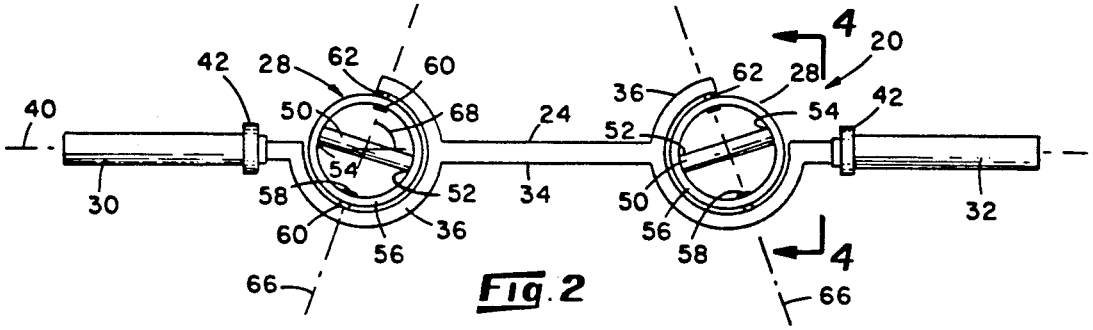
FIG. 2 is a front elevational view of the apparatus illustrated in FIG. 1 shown with the weights removed therefrom.
Figure 3:
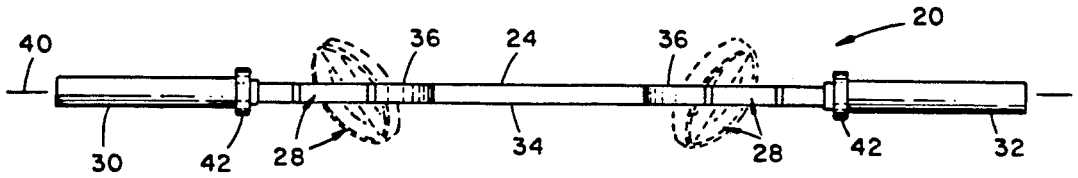
FIG. 3 is a plan view of the FIG. 1 apparatus as seen from above in FIG. 2.

With reference to FIGS. 2 and 3, the frame 24 of the apparatus 20 includes two opposite end sections 30, 32, a mid-section 34 are substantially straight and aligned with one another so that the longitudinal axis of each section 30, 32 or 34 is coincident with the longitudinal axis 40 of the frame 24. Each of the end sections 30, 32 is cylindrical in form along a major portion of its length, and each of the mid-section 34 and arcuate sections 36 is formed of hollow square tubing. The frame 24 is preferably constructed of steel.

Each end section 30 or 32 includes a collar 42 fixed at a predetermined distance from the corresponding end of the section 30 or 32 and cooperates with a removable clamp 44 (FIG. 1) positioned about the end section 30 or 32 for securing the weights 26 to the frame 24. Each clamp 44 is conventional in construction having a body positionable about the end section 30 or 32 and a set screw which may be tightened against the surface of the end section 30 or 32 for maintaining the clamp 44 in position along the end section 30 or 32. Each weight 26 is also conventional in construction and includes a central hole through which the end section 30 or 32. Each weight 26 is also conventional in construction and includes a central hole through which the end section 30 or 32 extends. With the weights 26 positioned against the collars 42 as shown in FIG. 1 and each clamp 44 positioned against the weights 26 and tightened onto the end sections 30, 32, the weights 26 are firmly held upon the frame 24 between the collars 42 and the clamps 44.

Each arcuate section 36 is in the form of a C having a portion which is joined to the end section 30 or 32 and an opposite portion which joined to the mid-section 34. The arcuate sections 36 are arranged so that the C's of the sections 36 are generally spaced equidistant from the center of the frame 24 and are co-planar with one another.

Each hand grip assembly 28 includes an elongated, substantially straight grip 50 having two opposite ends 52, 54 and a ring 56. The grip 50 extends generally across the center of the ring 56, and its ends 52, 54 are joined at diametrically opposed locations on the ring 56. The grip 50 is cylindrical in form, sized to be comfortably grasped by a hand of the user 22 and, like the ring 56, is preferably constructed of steel.

It is a feature of the present invention that the ring 56 of each hand grip assembly 28 is pivotally connected to the frame 24 in a manner which permits the wrists of the user to be adjusted in position, such as by either rotating the wrists or bending of the hands at the wrists, during an exercise routine to lessen the likelihood of wrist strain. In the depicted apparatus 20, each ring 56 is positioned within a corresponding C of an arcuate section 36 and is pivotally joined thereto by means of headed bolts 58 having shanks that loosely extend through openings 60 provided at diametrically-opposed locations on the sides of the ring 56 and which are fixed, as by welding, to the arcuate sections 36. A spacer 62 is positioned about each bolt shank between the outer surface of the ring 56 and the inner surface of the corresponding arcuate section 36 to maintain the rings 56 centrally of the arcuate sections 36.

As best shown in FIG. 2, the bolts 58 join the rings 56 to the arcuate sections 36 so that the axis of pivot, indicated as 66, of each ring 56 is generally orthogonal to its corresponding grip 50 so as to intersect the grip 50 at a location substantially midway between the grip ends 52, 54 and is oriented at a fixed angle with respect to the longitudinal axis 40 of the frame 24. In the depicted embodiment 20, each pivot axis 66 forms with the longitudinal axis 40 an angle 68 of about seventy degrees so that the ring pivot axes 66, 66 intersect at a location remote of the frame 24 at an angle of about forty degrees. Such an angular disposition of the pivot axes 66 relative to the frame axis 40 has been found to be desirable when performing curling and other two-handed exercises with the apparatus 20.

It is a feature of the present invention that each of the ring pivot axes 66, 66 is fixed in position relative to the frame 24. The term "fixed pivot axis" for present purposes should therefore be understood as reference to a pivot axis which is fixed in position relative to the apparatus frame.

Figure 4:
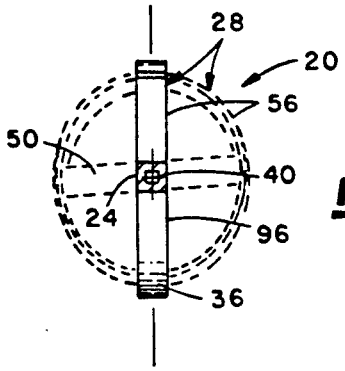
FIG. 4 is a cross-sectional view taken along line 4—4 of FIG. 2.

When using the apparatus 20 during the curling exercise depicted in FIG. 1, the user's hands are grasped about the grips 50 of the hand grip assemblies 28, and the frame 24 is repeatedly raised and lowered with the hands between the FIG. 1 solid line position and the FIG. 1 phantom-line position as the user's arms are moved between folded and extended conditions. As the frame 24 is raised and lowered as aforedescribed, the hand grip assemblies 28 may be pivoted relative to the frame 24 about the pivot axes 66. By way of example, there are illustrated in FIGS. 3 and 4 two positions of a hand grip assembly 28, one of which is shown in solid lines and the other of which is shown in phantom, between which the assembly 28 may be pivoted as the frame 24 is moved between its lowered and raised positions of FIG. 1. The hand grip assemblies 28 thereby accommodate an adjustment of the user's hands relative to the frame 24 during the exercise routine. Such an adjustment of the user's hands may be particularly desirable during exercises which may otherwise require that the exercise apparatus and the weights attached thereto be bodily rotated by the wrists as the apparatus is raised and lowered.

Figure 5:
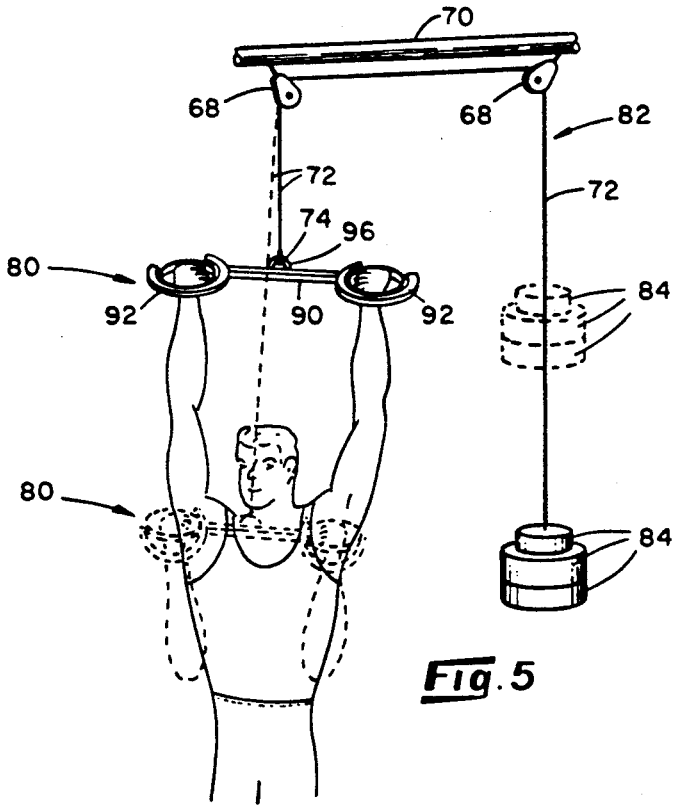
FIG. 5 is a perspective view of another embodiment of an exercise apparatus shown being used during an exercise routine.
Figure 6:
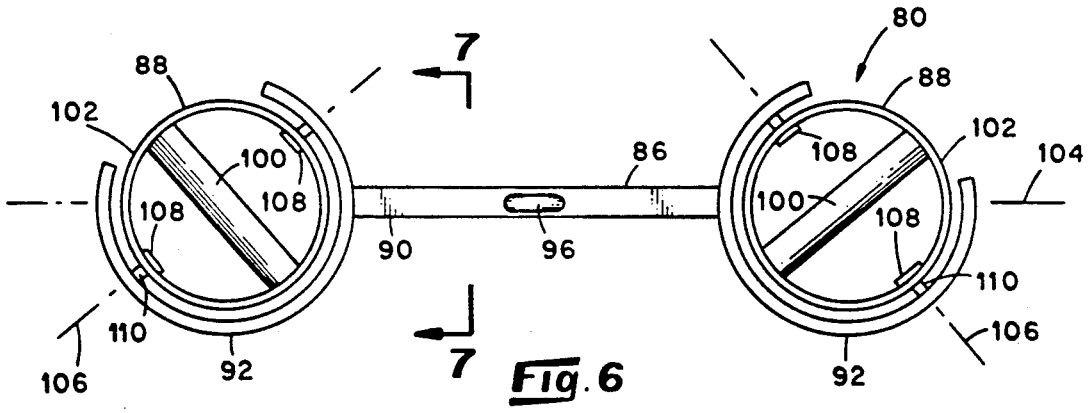
FIG. 6 is a plan view of the FIG. 5 apparatus as seen from above in FIG. 5.
Figure 7:
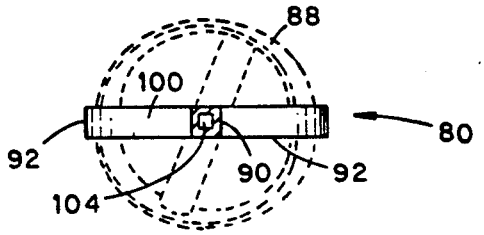
FIG. 7 is a cross-sectional view taken along line 7—7 of FIG. 6 and rotated ninety degrees.

With reference to FIGS. 5-7, there is illustrated an embodiment 80 of an exercise apparatus adapted to be connected to weights 84 by way of a overhead cable and pulley arrangement 82 so that the weights 84 offer a resistance to a downward pull upon the apparatus 80 from a raised position. In the depicted arrangement 82, a pair of pulleys 68 are connected to a stationary overhead object 70, and a cable 72 extends through each pulley 68. One end of the cable 72 supports the weights 84 and the other end of the cable 72 has a hook 74 for attachment to the apparatus 80.

The apparatus 80 includes a frame 86 and a pair of hand grip assemblies 88 pivotally joined to the frame 86. During an exercise routine performed with the apparatus 80, the hand grip assemblies 88 are grasped by the user's hands and the frame 86 is pulled downwardly with the arms from a raised position as illustrated in solid lines in FIG. 5 to a lowered position as illustrated in phantom in FIG. 5. The frame 86 is subsequently permitted to slowly return to its raised position.

The frame 86 of the apparatus 80 includes an elongated, substantially straight mid-section 90 and a pair of arcuate end sections 92 joined to the mid-section 90 at opposite ends thereof. An eyelet 96 is fixedly joined to the midsection 90 at a location substantially midway along the length thereof and enables the hook 74 of the cable 72 to be releasably connected to the frame 86. Each arcuate section 92 is C-shaped in form and arranged in a coplanar relationship with the other arcuate section 92 so that the C's of the sections 92 open generally away from the same side of the frame 86. Each of the frame sections 90 and 92 is formed of hollow square tubing and is preferably constructed of steel.

Each hand grip assembly 88 includes an elongate, generally straight grip 100 and a ring 102 encircling the grip 100. The ends of each grip 100 are fixedly joined at two diametrically-opposed locations on its corresponding ring 102 so that each grip 100 extends generally across the center of its ring 102. Each ring 102 is, in turn, pivotally connected to a corresponding one of the arcuate sections 92 to permit the hand grip assemblies 88 to pivot relative to the frame 86.

Each hand grip assembly 88 is centered within the C of its corresponding arcuate section 92 and is pivotally joined to the arcuate section 92 for pivotal movement about a pivot axis 106 which is oriented in an angular relationship with the longitudinal axis 104 of the frame 86. In the depicted apparatus 80, each pivot axis 106 forms a fixed angle of about forty-five degrees with the frame axis 104 so that the two pivot axes 106 intersect and form an angle of about ninety degrees at a location remote of the frame 86. Each pivot axis 106 is orthogonal to its corresponding grip 100 and intersects the grip 100 midway between its ends. Pivotal attachment of each hand grip assembly 88 to a corresponding arcuate section 92 is effected by headed bolts 108 having shanks which extend through openings provided in opposite sides of the rings 102 and which are fixedly attached, as by welding, to the arcuate sections 92. A sleeve-like spacer 110 is positioned about the shank of each bolt 108 and between the outside surface of the ring 102 and inside surface of the corresponding arcuate section 92. Of course, the shanks of the bolts 108 are slightly smaller in diameter than that of the ring openings through which the shanks of the bolts 108 extend so that the hand grip assemblies 88 are free to pivot relative to the apparatus frame 86.

When using the apparatus 80 to perform the exercise routine depicted in FIG. 5, the grips 100 are grasped by the user's hands and the frame 86 is moved with the arms between its raised and lowered positions of FIG. 5. As the apparatus 80 is moved between the illustrated raised and lower positions, the hand grip assemblies 88 are permitted to pivot relative to the frame 86 between two pivotal positions, such as between the FIG. 6 position in which each ring 102 is substantially co-planar with the corresponding arcuate section 92 and the phantom-line position of FIG. 7. Because the upward pull upon the frame 86 at the eyelet 96 by the weights 84 resists any tendency of the frame 86 to rotate about its longitudinal axis 104 during the exercise routine, the permitted pivotal movement of the hand grip assemblies 88 during the exercise routine substantially eliminates the strain to which the wrists would otherwise be exposed if the wrists were required to work against the resistance of the frame 86 to rotation.

Figure 8:
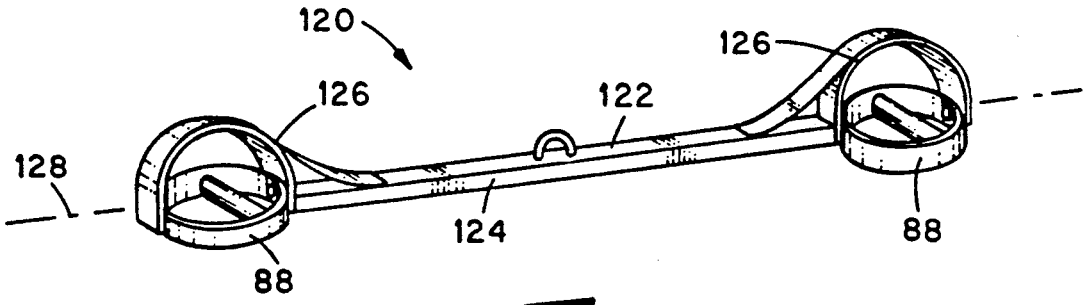
FIGS. 8–10 are perspective views of alternative embodiments of an exercise apparatus within which features of the present invention are embodied.

Although the apparatus 80 of FIGS. 5-7 has been shown and described as including hand grip assemblies 88 which are pivotally joined to the frame 86 so that the pivot axis of each assembly 88 is disposed in an angular relationship with respect to the longitudinal axis 104 of the frame 86, an apparatus in accordance with the broader aspects of this invention may possess hand grip assemblies which pivot about axes which are coincident with the longitudinal axis of the apparatus frame. For example, there is illustrated in FIG. 8 a pull-down apparatus 120 having a frame 122 including a straight mid-section 124 and two arcuate sections 126 joined to opposite ends of the mid-section 124 and hand grip assemblies 88 arranged within and pivotally joined to the arcuate sections 126. The frame 122 includes a longitudinal axis 128, and each hand grip assembly 88 is permitted to pivot about a pivot axis which is coincident with the longitudinal axis 128 of the frame 86.

Figure 9:
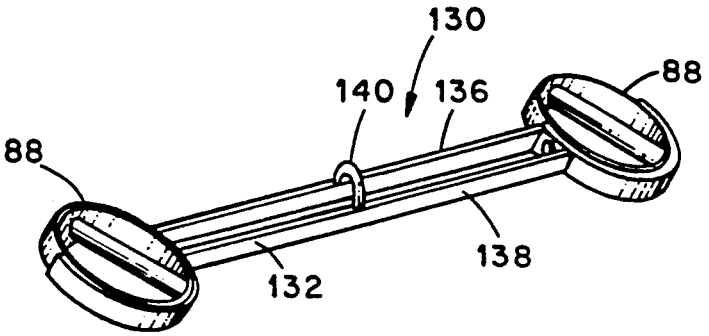

In addition, although the apparatus 80 of FIGS. 5-7 has been shown and described as including a frame 86 having a mid-section 90 comprised of a single bar, the frame of an exercise apparatus in accordance with the broader aspects of this invention may take an alternative form. For example, there is illustrated in FIG. 9 another embodiment 130 of a pull-down apparatus having a pair of hand grip assemblies 88 and a frame 132 to which the hand grip assemblies 88 are pivotally connected. In the depicted apparatus 130, the frame 132 includes a mid-section 134 including a pair of bar members 136, 138 arranged in parallel relation and an eyelet 140 fixedly attached across the bar members 136, 138.

Figure 10:
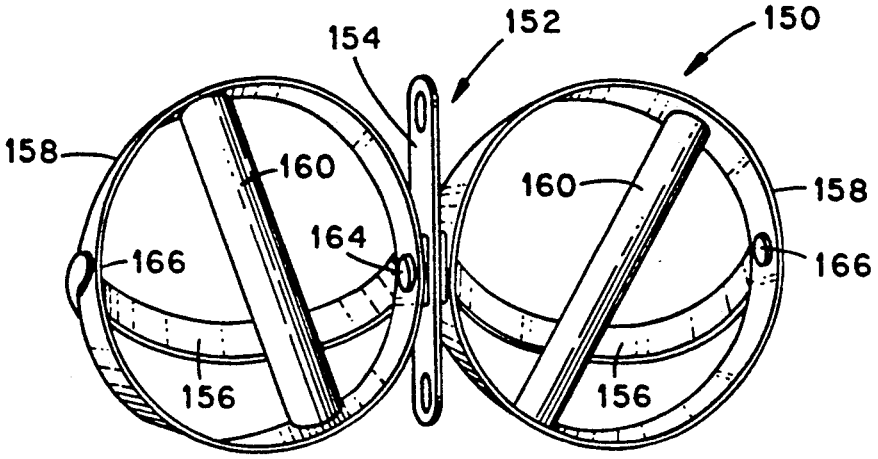

With reference to FIG. 10, there is shown a further embodiment, indicated 150, of an exercise apparatus in which various features of the present invention are embodied. The apparatus 150 may be used as a pull-down apparatus in conjunction with the overhead cable and pulley arrangement 82 of FIG. 5 as the apparatus 150 is moved by the user's hands between raised and lowered positions. In particular, the apparatus 150 may be substituted for one of the apparatus of FIGS. 5-9 for the performance of a pull-down exercise routine during which the user desires to maintain his hands relatively close together. To this end, the apparatus 150 includes a frame 152 having a brace 154 to which the hook 74 of the FIG. 5 cable may be attached and a pair of arcuate C-shaped sections 156 joined to opposite sides of the brace member 154 by means of a bolt 164 which extends through aligned openings in the brace member 154 and arcuate sections 156. The apparatus 150 also includes a pair of hand grip assemblies 158 positioned between and pivotally joined to the arcuate sections 156 in a manner which permits the hand grip assemblies 158 to pivot relative to the frame 152.

Each hand grip assembly 158 includes a ring 162 and an elongated, substantially straight grip 160 having opposite ends which are joined to the ring 162 at diametrically-opposed locations. Each hand grip assembly 158 is positioned within the C of a corresponding section 156 and pivotally joined thereto for pivotal movement of the hand grip assemblies 158 relative to the frame 152 by means of the aforementioned bolt 164 and a headed pin 166 which extends through an opening provided in the ring 162 opposite the bolt 164. In the depicted apparatus 150, the hand grip assemblies 158 are adapted to pivot relative to the frame 152 about coincident pivot axes. Moreover, the grip 160 of each hand grip assembly 158 is orientated in a fixed angular relationship with the pivot axis of its assembly 158. In the depicted embodiment, the longitudinal axis of each grip 160 is orientated at about a seventy degree angle with the pivot axis of the corresponding hand grip assembly 158.

It will be understood that many modifications and substitutions may be had to the aforedescribed embodiments without departing from the spirit of the invention. Accordingly, the aforedescribed embodiments are intended for the purpose of illustration and not as limitation.

I claim:

1. An exercise apparatus which comprises:

a frame;

resistance means connected to the frame for providing a force in opposition to attempted movement of the frame between first and second positions;

a grip for enabling a user to grip and hold the frame along a grip axis for moving the frame between the first and second positions in opposition to the resistance means;

a ring member to which said grip is attached so that said grip extends across said ring member and is prevented from moving relative to said ring member about an axis oriented perpendicular to said grip axis; and means pivotally connecting said ring member to said frame for pivotal movement of said ring member relative to said frame about one fixed pivot axis disposed across said ring member and generally perpendicular to said grip axis so that during use of the apparatus, the ring member is permitted to pivot only about said one pivot axis.

2. The exercise apparatus of claim 1 wherein said grip is elongated in form and said grip axis corresponds with the longitudinal axis of said grip.

3. The exercise apparatus of claim 1 wherein said grip is a first grip, said grip axis is a first grip axis, said ring member is a first ring member and said apparatus further includes a second grip for enabling a user to grip and hold the frame along a second grip axis for moving the frame between first and second positions in opposition to the resistance means;

a second ring member supporting said second grip thereacross; and means pivotally connecting said second ring member to said frame for pivotal movement of said second ring member relative to said frame about a fixed pivot axis disposed across said ring member and generally perpendicular to said second grip axis.

4. The exercise apparatus of claim 3 wherein the fixed pivot axes about which the ring members are permitted to pivot are co-planar.

5. The exercise apparatus of claim 4 wherein the frame is elongated in form and has a longitudinal axis which extends generally across the ring members, and the fixed pivot axes about which the ring members are permitted to pivot are substantially co-planar with the longitudinal axis of the frame.

6. The exercise apparatus of claim 5 wherein the fixed pivot axes about which the ring members are permitted to pivot are each oriented in an angular relationship with the longitudinal axis of the frame and the angle which one of the fixed pivot axes forms with the longitudinal axis of the frame is equal to the angle which the other of the fixed pivot axes forms with the longitudinal axis of the frame.

7. An exercise apparatus for performing two-handed exercises comprising:

a frame to which resistance means are connectible for providing a force in opposition to attempted movement of the frame between two positions of movement; and a pair of hand grip assemblies with which the frame is moved by the user between the two positions of movement during an exercise routine, each hand grip assembly including a substantially straight, elongate grip having two opposite ends and a ring, the opposite ends of each grip being joined to opposite sides of the ring so that grip extends generally across the center of the ring and so that the grip is prevented from moving relative to the ring about an axis oriented generally perpendicular to the grip;

each ring being pivotally connected to the frame in a manner which permits the ring to pivot relative to the frame about one pivot axis which is fixed in relation to said frame, which intersects the grip at a location approximately midway along the length of the grip and which intersects the ring at locations on the ring which are substantially diametrically opposed to one another so that when the frame is moved between two positions of movement with the hands grasped about the elongate grips, each ring is permitted to pivot relative to the frame only about its corresponding one pivot axis to accommodate an adjustment of the wrists of the grasping hands.

8. The exercise apparatus of claim 7 wherein the two pivot axes about which the hand grip assemblies are permitted to pivot relative to the frame are co-planar.

9. The exercise apparatus of claim 8 wherein the frame is elongated in form and has a longitudinal axis which extends generally across the hand grip assemblies, and the two pivot axes of the hand grip assemblies are substantially co-planar with the longitudinal axis of the frame.

10. The exercise apparatus of claim 9 wherein the two pivot axes of the hand grip assemblies are each oriented in an angular relationship with the longitudinal axis of the frame and the angle which one pivot axis forms with the longitudinal axis of the frame is equal to the angle which the other pivot axis forms with the longitudinal axis of the frame.

11. The exercise apparatus of claim 10 wherein the angle which each pivot axis forms with the longitudinal axis of the frame is within the range of about forty to seventy-five degrees.

12. The exercise apparatus of claim 10 wherein the two pivot axes are coincident with one another.

13. The exercise apparatus of claim 7 wherein the frame includes an elongated mid-section and a pair of arcuate sections joined to the mid-section at opposite ends thereof so that the arcuate sections are maintained in a spaced relationship, each of the arcuate sections being C-shaped and arranged in a co-planar relationship and each of the hand grip assemblies being positioned within the C of a corresponding arcuate section and pivotally joined thereto.

14. An exercise apparatus for performing two-handed exercises wherein the apparatus is moved by the user's hands between two positions of movement, said apparatus comprising:

a frame to which resistance means are connectible for providing a resistance to movement of the apparatus between two positions and including a pair of C-shaped arcuate sections maintained in a spaced and co-planar relationship; and a pair of hand grip assemblies with which the frame is moved by the user between two positions of movement during an exercise routine, each hand grip assembly including a substantially straight, elongate grip having two opposite ends and ring, the opposite ends of each grip being joined to opposite sides of the ring so that the grip extends generally across the center of the ring and so that the grip is prevented from moving relative to the ring about an axis oriented generally perpendicular to the grip;

each ring being positioned within the C of a corresponding arcuate section and pivotally joined to the arcuate section for pivotal movement of the ring relative thereto about one pivot axis which is fixed in relation to said frame, which intersects the corresponding grip at a location approximately midway along the length of the grip and which intersects the ring at locations on the ring which are substantially diametrically-opposed to one another so that when the frame is moved between two positions of movement with the hands grasped about the elongate grips, each ring is permitted to pivot relative to the frame only about its one corresponding pivot axis to accommodate an adjustment of the wrists of the grasping hands;

the two pivot axes about which the hand grip assemblies are permitted to pivot relative to the frame are co-planar with one another and with the C-shaped arcuate sections.

15. The exercise apparatus of claim 14 wherein the frame is elongated in form and has a longitudinal axis which extends generally across the hand grip assemblies, and the two pivot axes of the hand grip assemblies are substantially co-planar with the longitudinal axis of the frame.

16. The exercise apparatus of claim 15 wherein the two pivot axes of the hand grip assemblies are each oriented in an angular relationship with the longitudinal axis of the frame and the angle which one pivot axis forms with the longitudinal axis of the frame is equal to the angle which the other pivot axis forms with the longitudinal axis of the frame.

17. The exercise apparatus of claim 16 wherein the angle which each pivot axis forms with the longitudinal axis of the frame is within the range of about forty to seventy-five degrees.

18. The exercise apparatus of claim 14 wherein the two pivot axes are coincident with one another.

19. The exercise apparatus of claim 14 wherein the pivot axis about which each hand grip assembly is permitted to pivot is arranged in an orthogonal relationship with the grip of the hand grip assembly.

20. The exercise apparatus of claim 14 wherein the C of each arcuate section is sized to permit the ring positioned therein to be rotated through an entire revolution about its one pivot axis.

* * * * *

UNITED STATES PATENT AND TRADEMARK OFFICE

CERTIFICATE OF CORRECTION

PATENT NO. : 5,080,349

DATED : January 14, 1992

INVENTOR(S) : Larry W. Vittone

It is certified that error appears in the above-identified patent and that said Letters Patent is hereby corrected as shown below:

Col. 2, line 49, after "34," insert --and two arcuate sections 36 joining the end sections 30, 32 to the mid-section 34. The end sections 30, 32 and the mid-section 34--.

Col. 2, line 66, after "32," delete --Each weight 26 is also conventional in construction and includes a central hole through which the end section 30 or 32.--.

Signed and Sealed this

Twentieth Day of July, 1993

*Attest:*

Michael K. Kirk

MICHAEL K. KIRK

*Attesting Officer*

*Acting Commissioner of Patents and Trademarks*